United States Patent [19]

Fromme et al.

[11] 4,376,585

[45] Mar. 15, 1983

[54] COMBINED PAPER ADVANCE AND INK RIBBON FEED SYSTEM

[75] Inventors: Lorenz Fromme, Ulm; Wolfgang Hendrischk, Neu-Ulm; Werner Rupp, Nersingen-Leibi, all of Fed. Rep. of Germany

[73] Assignee: Mannesmann Aktiengesellschaft, Dusseldorf, Fed. Rep. of Germany

[21] Appl. No.: 250,116

[22] Filed: Apr. 2, 1981

[30] Foreign Application Priority Data

Apr. 15, 1980 [DE] Fed. Rep. of Germany ..... 3014822

[51] Int. Cl.[3] ..... B41J 23/34; B41J 33/32; B41J 19/92

[52] U.S. Cl. ..... 400/185; 400/225; 400/233; 400/314.1; 400/322; 400/568

[58] Field of Search ..... 400/121, 124, 185, 186, 400/225, 233, 314.1, 320, 322, 323, 328, 568, 611

[56] References Cited

U.S. PATENT DOCUMENTS

| | | | |
|---|---|---|---|
| 1,399,993 | 12/1921 | Pfannenstiehl | 400/568 X |
| 1,762,749 | 6/1930 | Tauschek | 400/611 |
| 2,456,734 | 12/1948 | Ritzert | 400/185 |
| 3,120,177 | 2/1964 | Clark | 400/225 X |
| 3,387,081 | 6/1968 | Kleinschmidt et al. | 400/568 X |
| 3,707,214 | 12/1972 | Ponzano | 400/568 X |
| 3,840,107 | 10/1974 | Mack et al. | 400/185 |
| 3,986,594 | 10/1976 | Kondur | 400/185 |
| 4,044,883 | 8/1977 | Boehmer | 400/225 X |
| 4,062,436 | 12/1977 | Kondur et al. | 400/185 X |
| 4,265,551 | 5/1981 | Adamek et al. | 400/225 X |

FOREIGN PATENT DOCUMENTS

| | | | |
|---|---|---|---|
| 55-142683 | 11/1980 | Japan | 400/185 |
| 55-142684 | 11/1980 | Japan | 400/185 |
| 7608038 | 2/1977 | Netherlands | 400/225 |

OTHER PUBLICATIONS

*IBM Tech. Disc. Bulletin*, "Ribbon Drive", by R. G. Cross, vol. 15, No. 7, Dec. 1972, p. 2312.

*Primary Examiner*—Paul T. Sewell

*Attorney, Agent, or Firm*—Ralf H. Siegemund

[57] ABSTRACT

A matrix printer, having a movable print head, a paper feed and advance mechanism and an ink ribbon system, is driven by two motors; one for the print head and one for paper feeding and ribbon movement. This second motor is a reversible one and drives the paper advance when rotating in one direction and the ink ribbon when rotating in the opposite direction. Speed control for the paper feed phase is derived from a cam on the input shaft for the paper advance. A reset mechanism for that shaft is also included.

11 Claims, 3 Drawing Figures

COMBINED PAPER ADVANCE AND INK RIBBON FEED SYSTEM

BACKGROUND OF THE INVENTION

The present invention relates to a printer, particularly a matrix printer.

Printers of the type to which the invention pertains are constructed to have a matrix print head which is being moved by means of a drive across a print surface and adjacent to an ink ribbon. Supplemental drives are provided for paper advance and for advancing the ink ribbon. These supplemental drives may be separate motors which, however, operate only alternatingly as the ribbon is advanced during printing only and paper is advanced when printing proper is not in progress.

It is also known to branch the supplemental drive power from the print head drive, thus being the main drive of the system. That common drive motor has to have a higher power rating accordingly in order to be able to drive the print head carriage, the ink ribbon system, and the paper advance mechanism. While seemingly economical from the viewpoint of the number of drives (versus three drives), the linkage has posed some problems.

DESCRIPTION OF THE INVENTION

It is an object of the present invention to improve the driving mechanism of printers.

It is a particular object of the present invention to improve printers having a movable print head, a paper advance mechanism, and an ink ribbon system.

In accordance with the preferred embodiment of the present invention, it is suggested to provide a first drive motor for the print head, and a common second drive motor for the ink system and for the paper advance. The second motor is reversible and is coupled to the ink ribbon system when rotating in one direction only, and to the paper advance system only when rotating in the opposite direction. The driving connection includes preferably a common rotating member with two one-way, freewheeling clutches responding to oppositely directed rotations and, respectively, coupling one or the other of two shafts to that common member. These two shafts provide the immediate rotational inputs for the ink ribbon and paper advance systems. In addition, the input shaft for the paper advance system carries a cam through which the motor speed is varied during paper advance for a first fast phase to be followed by a slower second phase. Following a motor reversal for a change-over from paper advance to ink ribbon advance, a spring bias returns the cam to an accurately defined starting position.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

Proceeding now to the detailed description of the drawings, FIG. 1 illustrates a matrix print head 1 of conventional design and being mounted on a carriage 2 for moving on and along a rail and guide rod 3. This rod 3 is mounted in two bearings 6 for rotation on its axis. Moreover, two excentric pins 4 and 5 are mounted to the two ends of rod 3. These pins 4 and 5 bear respectively and resiliently against plates 18 and 19.

Figure 1:
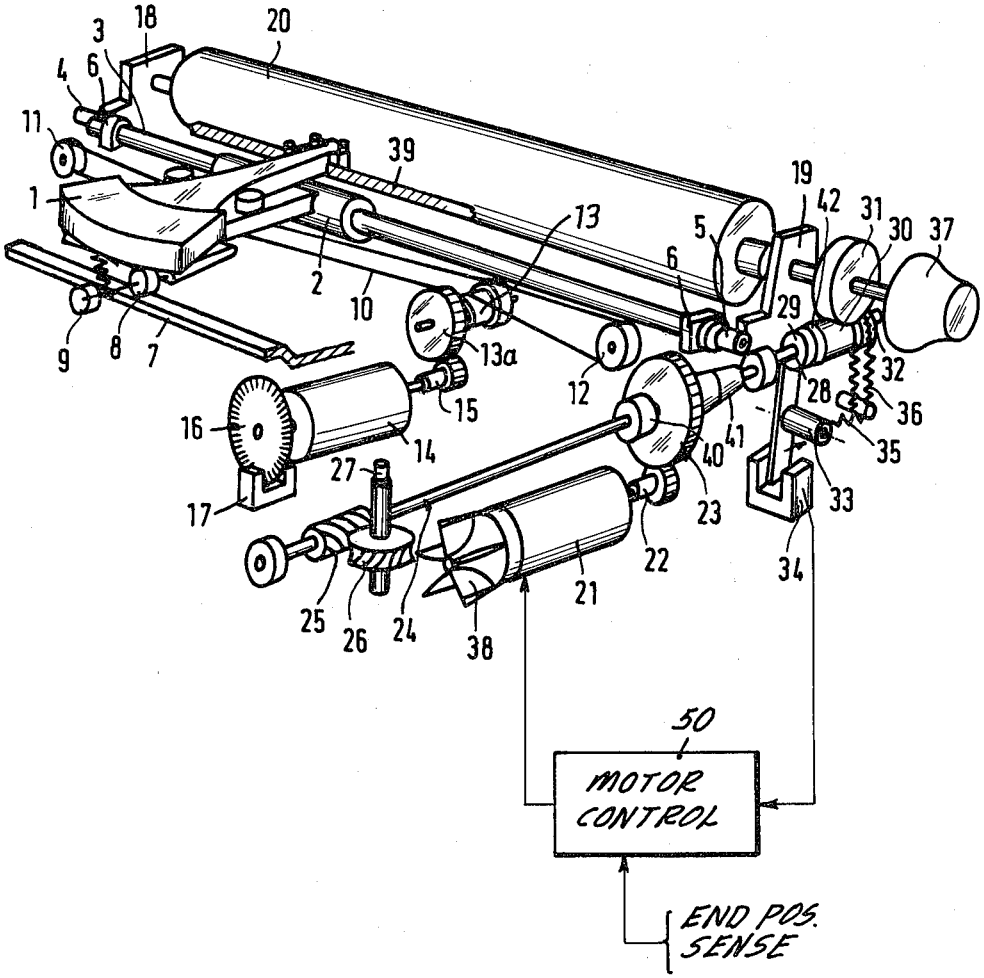
FIG. 1 is a perspective view of a portion of a matrix printer, showing particularly an example of the preferred embodiment of the invention for practicing the best mode thereof.

The tubular portion of carriage 2 supports primarily the narrow front end of print head 1. The carriage portion near the rather wide rear end of the print head is provided with two rolls or rollers 8 and 9 which run on a flat rail bar 7. The carriage 2 is pulled by means of a cable or wire 10 which is fastened to the carriage as well as to a winch drum 13. A gear **13*a* is coaxially mounted to drum 13, meshing a pinion gear 15 which, in turn, is driven by the print head drive motor 14. The carriage drive system includes additionally a pair of reversing pulleys 11 and 12 which also tension the cable 10**.

In accordance with the specific features of the invention, a common auxiliary, reversible motor 21 is provided for driving the ink ribbon 39 and the paper advance. The paper advance includes a platen roller 20. The ink ribbon is held in a cartridge (not shown) which is fastened to the cover of the printer. The motor 21 is coupled to the ink ribbon system and to the paper advance system in a manner that it drives one or the other, depending upon its direction of rotation.

Motor 21 has a drive shaft 22 which carries a pinion 22 meshing a gear 23. That gear 23 contains two freewheeling, one-way couplings, followers, or clutches 40 and 41. It should be mentioned that these followers or one-way clutches 40 and 41 are actually disposed inside gear 23; but they are shown here on its outside for the sake of improved illustration. The gear constitutes a common drive member from which different drive trains branch off.

As stated, the drive motor 21 is reversible; depending upon its direction of rotation and, therefore, on the direction of rotation of gear 23, that gear is either coupled to a shaft 24 being the input shaft of the ink ribbon system, or to a shaft 28 pertaining to the paper advance as input shaft thereof. Shaft 28 is adjustable in longitudinal direction in order to compensate the adjustment of the paper's advance to the desired paper thickness. This latter adjustment is carried out by the eccentric cams 5 and 6, controlling the relative position between the platen roller or drum 20 and the print head 2.

As far as the ink ribbon system is concerned, shaft 24 is the drive input for that system, and it carries a worm gear 25, meshing a matching gear 26. Gear 26 is internally provided with a freewheeling, one-way clutch or follower to carry along a shaft 27 when rotating in the desired direction. Shaft 27 carries a key on its upper end which can be inserted in a cartridge for an ink ribbon. When the cartridge is put in place for that purpose, shaft 27 is drivingly coupled to a spool therein and is capable of driving the spool one way in order to advance the ribbon 39. As stated, this cartridge or cassette is usually mounted (additionally) in a top cover (not shown) of the printer.

Turning now to the paper feed and advance system, its immediate drive input is shaft 28, carrying a worm gear 30 which meshes a matching gear 31. In addition, shaft 28 carries a cam 29, having a spirally (but axially) increasing control surface with a step, resulting in a latching nose for a lever 33.

Figures 2, 3:
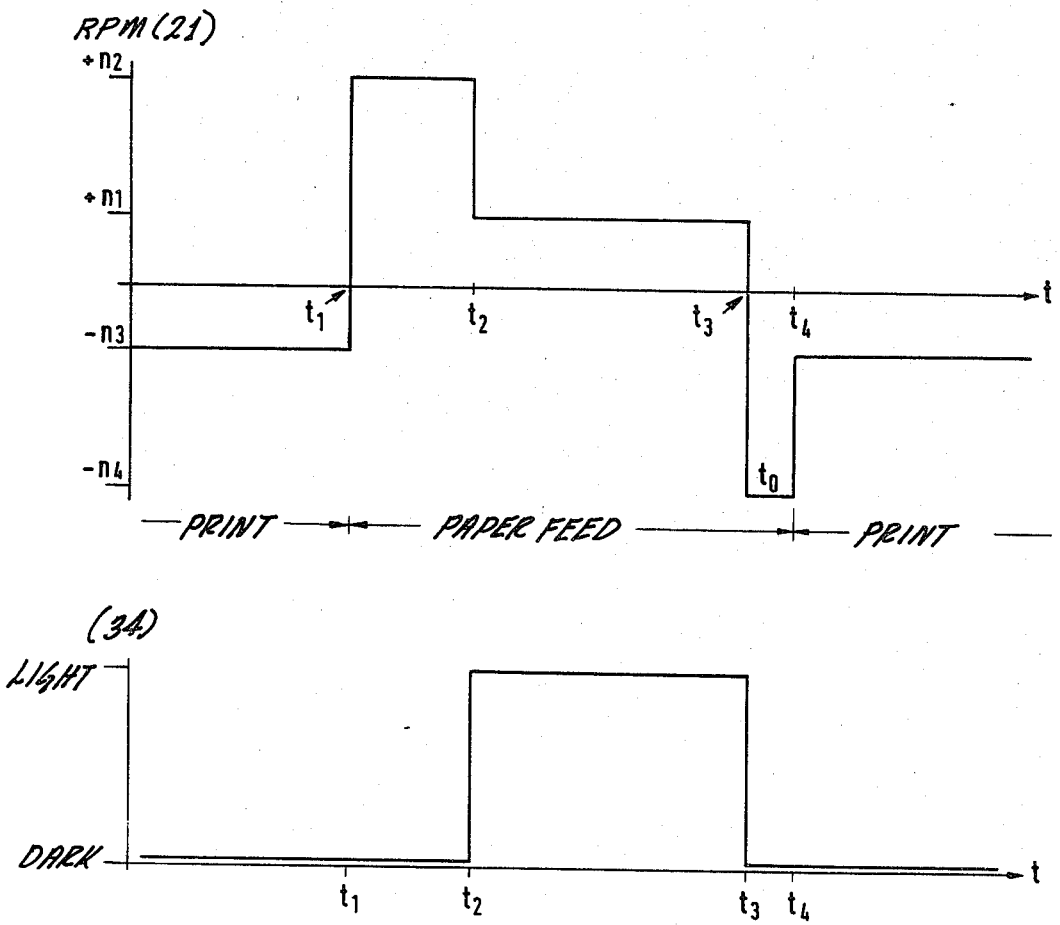
FIG. 2 is a diagram in which a motor RPM is plotted against time.
FIG. 3 is a diagram drawn in vertical time-alignment with FIG. 2 and showing a particular control signal as it occurs and is produced in the apparatus shown in FIG. 1.

Lever 33 engages the control surface of cam 29 and is held against that cam by a tension spring 35. The lower end of lever 33 dips into the path of a beam of light set up by a photoelectric monitor or scanner 34. The lever 33 is adjusted so that, at an approximately median position of the cam's surface, the lower end of lever 33 is on the border line between interrupting and not interrupting the light path. When the lowest portion of cam surface 29 engages lever 33, i.e., when the lever is just about to abut the step of the nose, the light path is completely interrupted; when on top of the nose, the light path is free. Thus, during one revolution of cam 29, beginning from a lowest position of lever 33 at the nose, the beam of light remains interrupted until it reaches a medium position. Continued rotation leaves the light of beam unimpeded until, upon reaching the highest cam position, lever 33 drops over the nose, which again causes the beam of light to be interrupted. FIG. 3 illustrates the dark-light sequence.

A slip friction clutch 32 is also disposed on shaft 28. This clutch may, for example, be comprised of two semi rings being forced onto the shaft by means of O-rings and being further enveloped by tension spring 36. This spring 36 functions as a spring drive which is charged and tensioned upon rotation of shaft 28, to drive shaft 28 in the opposite direction when released and discharging. By means of this mechanism, shaft 28 can be placed in the zero position, as will be explained below.

As stated, worm gear 30 drives a gear 31 which, in turn, is coupled to the platen roller 20. This roller or drum 20 advances the paper. An alternative advance is provided by a push-in knob 37 with a one-way clutch. The worm gear 30 is coupled to shaft 28 by another one-way clutch so that, for the spring-biased reversal of shaft 28 by spring 36, the platen roller and the common drive member 23 are decoupled from this shaft 28.

The auxiliary or second drive motor 21 carries additionally a fan 38. In particular, a nose of that fan couples it to the motor shaft in such a manner that the fan is taken along upon rotation of the motor shaft in either direction; but upon reversal, the fan can make almost a complete turn relative to the shaft (in the "old" direction) before its nose is again coupled to the motor shaft to now reverse also its sense of rotation. This temporary decoupling of the motor from the fan acts as a load relief, permitting the motor 21 to reverse faster than under the full load of the fan.

A control circuit 50 is provided for controlling the motor 21. The motor will be caused to reverse at the end of each print pass, which may be initiated by carriage-end-position switches. This then marks the transition from ink ribbon to paper advance. The end of the paper advance is signalled by scanner 34 and causes motor 21 again to reverse in order to restart the ink ribbon phase again. The same signal can be used to restart print head motor 14 for the next printing pass.

The apparatus includes a second photoelectric system, 17, having a beam of light which is alternatingly interrupted by bars along the periphery of a control disk 16. This clock disk has, in fact, slots along its periphery so that, upon rotation of main drive motor 14, pulses are produced which represent print positions. This portion involves the control of print head motor 14 which is conventional.

The apparatus as described operates as follows (see also FIGS. 2 and 3). During printing, motor 14 runs and drives the carriage 2 in one or the opposite direction. Print position signals are derived from the scanner 17. Simultaneously, motor 21 runs in a direction that causes, for instance, gear 23 to turn clockwise. Freewheeling clutch 40 couples shaft 24 to gear 23, while shaft 28 is decoupled. The ribbon system, thus, moves the ink ribbon 39. The speed of motor 21 is shown to be $-n_3$ during this print phase mode. As will be explained below, this speed $-n_3$ is maintained during most of the printing phase.

At time $t_1$, the direction of rotation of motor 21 is reversed. This reversal may coincide with carriage 2 reaching a limit position. As motor 21 reverses, freewheeling one-way clutch 40 decouples from gear 23 and one-way clutch 41 connects shaft 28 to that gear 23. The motor speed is $+n_2$, which is higher than $-n_3$, aside from the sense of direction as indicated by "+" and "−" in FIG. 2. Thus, the paper advance begins with a rather high speed. The paper advance phase is further controlled as follows.

First of all, upon rotation of shaft 28, cam surface 29 moves lever 33 until, after approximately half a revolution, lever 33 opens the light path in scanner 34, at time $t_2$. The scanner now signals "light" to controller 50, whereupon the motor speed is reduced from $n_2$ to $n_1$. The purpose thereof is to move the paper at a slower speed during the final position phase of the paper; the paper advance is not to be abruptly halted from a relative high speed. The next half-revolution of cam 29 lasts accordingly longer ($t_2 \rightarrow t_3$).

At time $t_3$, lever 33 slides over the nose and drops to the lower contour portion of the surface of cam 29 to, thereby, block again the light path in scanner 34. The scanner thus signals "dark." This signal is used in controller 50 to reverse motor 21, again as fast as possible. As stated, the fan 38 is temporarily decoupled from motor 21 so that it does not contribute to the load. As motor 21 reverses, shaft 28 is again decoupled from gear 23 while shaft 24 is coupled thereto. The next print phase begins.

Following the decoupling of shaft 28 from gear 23, it does not halt. In other words, when lever 33 drops over the nose of cam 29, the shaft 28 will not stop instantly. There occurs a slight overshoot. After motor 21 has reversed and clutch 41 decouples, torque is no longer provided by motor 21 upon shaft 28. Thus, spring 36, acting through slip clutch 32, can now turn shaft 28 back a little, while the nose of curve 29 abuts lever 33. This way, it is ensured that the starting position of shaft 28 for the next paper advance occurs from this exactly predetermined position. The reversal of shaft 28 by operation of spring 36 is the smaller, the faster lever 33 drops physically above that nose, and the faster motor 21 is reversed thereafter.

The worm gear 30, through which the paper advance is carried out, is coupled to shaft 28 by means of the freewheeling one-way clutch 42 so that the paper advance itself is not reversed, and shaft 28 can be reset by spring 36 to the zero position, as defined by lever 33 at the nose of curve 29, without impediment by the feed load of the paper.

As stated, motor 21 is reversed at time $t_3$ and is actually switched to run at the relatively high speed $-n_4$. This speed is maintained for a short period only ($t_3 \rightarrow t_4$)

in order to tension the ribbon 39. Also, applying a high-speed signal to the motor 21 will speed up its reversal. This period $t_3 \rightarrow t_4$ may be metered in controller 50 through internal timing. Regular ink ribbon advance is carried out at the reduced speed $-n_3$ throughout its next print phase. It should be noted that the absolute RPM for $n_1$ and $n_3$ are the same; so are the values for $n_2$ and $n_4$.

The invention is not limited to the embodiments described above; but all changes and modifications thereof, not constituting departures from the spirit and scope of the invention, are intended to be included.

We claim:

1. In a printer having a print head, a paper advance mechanism, and an ink ribbon system, the print head being reversibly driven by a first motor, the combination for driving the paper advance mechanism and the ink ribbon system comprising:

a second reversible motor;

first means for coupling the paper advance mechanism to the second motor when rotating in a first direction;

second means for coupling the ink ribbon system to the second motor when rotating in a second direction, opposite the first direction; and whereby the first and second means respectively are decoupled from the second motor when the second motor rotates in the second or the first direction.

2. The combination as in claim 1, wherein the first mechanism includes a first shaft and a first one-way freewheeling clutch;

the second means includes a second shaft and a second one-way freewheeling clutch;

the first and second means including additional means drivingly coupled to the second motor and operatively connected to said clutches for driving the first or the second shaft, depending upon the sense of rotation as provided by the second motor upon said additional means.

3. The combination as in claim 1 or 2, the second means including cam control means for providing control signals during driving of the paper advance mechanism, to switch from an initially high speed to a low speed.

4. The combination as in claim 3 including means for placing a cam of the cam control means in a particular position following a reversal of the second motor from the second to the first direction.

5. In a printer as in claim 1, wherein the first and second means include a common gear transmission, drivingly connected to the second motor and having a particular gear, the first means including a first one-way clutch connected to one side of the gear, the second means including a second one-way clutch connected to an opposite side of the gear, decoupling of the second and first means being carried out by the one-way clutches.

6. In a matrix printer, a paper advance mechanism having a paper feed roller and comprising:

a reversible motor;

a shaft means;

a one-way coupling means for coupling the shaft means to the motor when rotating in one direction only;

a cam on the shaft means;

control means operated by the cam;

gear means for drivingly connecting the paper feed roller to the shaft means; and second control means operated by the first control means for causing the motor to reverse after one revolution of the cam.

7. In a matrix printer as in claim 6 and including spring-biased means for placing the cam in a particular position following said reversal.

8. In a printer as in claim 1, 2, or 6, including means for obtaining a temporary load relief on the motor when reversing in addition to decoupling from and by the respective one-way coupling means.

9. In a printer as in claim 6, the control means including a light barrier.

10. In a printer as in claim 9, the control means including a cam-operated spring-biased lever moving in and out of the barrier.

11. In a printer as in claim 10, wherein one cycle of lever movement corresponds to one line advance of the paper advance mechanism.

* * * * *